US007484592B2

(12) United States Patent
Porte et al.

(10) Patent No.: US 7,484,592 B2
(45) Date of Patent: Feb. 3, 2009

(54) SOUND ATTENUATION PANEL COMPRISING A RESISTIVE LAYER WITH REINFORCED STRUCTURAL COMPONENT

(75) Inventors: Alain Porte, Colomiers (FR); Jacques Lalane, Saint-Orens (FR)

(73) Assignee: Airbus France, Toulouse (FR)

( * ) Notice: Subject to any disclaimer, the term of this patent is extended or adjusted under 35 U.S.C. 154(b) by 819 days.

(21) Appl. No.: 10/473,031

(22) PCT Filed: Apr. 17, 2002

(86) PCT No.: PCT/FR02/01322

§ 371 (c)(1),
(2), (4) Date: Mar. 10, 2004

(87) PCT Pub. No.: WO02/084642

PCT Pub. Date: Oct. 24, 2002

(65) Prior Publication Data

US 2004/0148891 A1 Aug. 5, 2004

(30) Foreign Application Priority Data

Apr. 17, 2001 (FR) ..... 01 05209

(51) Int. Cl.
*E04B 1/82* (2006.01)

(52) U.S. Cl. ..... 181/292; 181/290; 181/291; 181/293; 52/781.14; 52/793.1

(58) Field of Classification Search ..... 52/782.1, 52/302.1, 784.14, 784.15, 793.1, 794.1; 156/306.9, 156/307.5, 312, 182–292; 442/7, FOR. 123, 442/FOR. 132; 181/283, 286, 288–293; 428/73–116, 118

See application file for complete search history.

(56) References Cited

U.S. PATENT DOCUMENTS

| | | | | | |
|---|---|---|---|---|---|
| 2,601,521 | A * | 6/1952 | Heftler | ..... | 210/488 |
| 3,166,149 | A * | 1/1965 | Hulse et al. | ..... | 181/292 |
| 4,254,171 | A * | 3/1981 | Beggs et al. | ..... | 428/116 |
| 4,294,329 | A * | 10/1981 | Rose et al. | ..... | 181/222 |
| 4,671,941 | A * | 6/1987 | Niina et al. | ..... | 422/131 |
| 6,021,612 | A * | 2/2000 | Dunn et al. | ..... | 52/144 |
| 6,176,964 | B1 * | 1/2001 | Parente et al. | ..... | 156/306.9 |
| 6,179,086 | B1 * | 1/2001 | Bansemir et al. | ..... | 181/292 |
| 6,607,625 | B2 * | 8/2003 | Andre et al. | ..... | 156/169 |
| 6,772,857 | B2 * | 8/2004 | Porte et al. | ..... | 181/210 |
| 6,840,349 | B2 * | 1/2005 | Andre et al. | ..... | 181/292 |
| 7,343,715 | B2 * | 3/2008 | Ito et al. | ..... | 52/309.16 |

FOREIGN PATENT DOCUMENTS

| | | |
|---|---|---|
| DE | 295 00 207 | 5/1996 |
| GB | 1 369 285 | 10/1974 |

* cited by examiner

*Primary Examiner*—Jeanette Chapman
(74) *Attorney, Agent, or Firm*—Young & Thompson

(57) ABSTRACT

A sound attenuation panel includes a resistive layer with a reinforced structural component, comprising at least a honeycomb structure (1) flanked, on one side, with a resistive layer (2) consisting of at least a porous layer (2*b*) and of at least a perforated structural layer (2*a*), and, on the other side, with a layer forming a total reflector (3). The structural layer (2*a*) is perforated with non-circular holes (4) having each its largest dimension and its smallest dimension along respectively two perpendicular axes. The panel is particularly applicable to pods for aeroplane jet engines.

9 Claims, 3 Drawing Sheets

SOUND ATTENUATION PANEL COMPRISING A RESISTIVE LAYER WITH REINFORCED STRUCTURAL COMPONENT

FIELD OF THE INVENTION

The present invention relates to acoustic attenuation panels, particularly panels adapted to be mounted in the walls of nacelles of aircraft jet engines, in the jet engine frames, in the conduits that are to be soundproofed and, generally speaking, to panels combining good properties both of acoustics and of structural resistance.

BACKGROUND OF THE INVENTION

In practice, this type of panel integrates a cellular core, such as a honeycomb structure flanked on the incident sound wave side, with an acoustic damping layer and, on the opposite side, with a rear reflector.

The acoustic damping layer is a porous structure with a dissipating function, which is to say partially transforming the acoustic energy of the sound wave passing through it, into heat.

This porous structure can be for example a metallic cloth or a cloth of carbon fibers whose weave permits fulfilling its dissipating function.

As these acoustic panels should, for example in the case of panels for the nacelles of jet engines, also have sufficient structure properties particularly to receive and transfer aerodynamic and inertial forces and forces connected to the maintenance of the nacelle, toward the structural nacelle/motor connections, it is necessary to give the acoustic damping layer structural properties.

To this end, it has already been proposed to provide an acoustic damping layer with two superposed components, one structural and the other porous and dissipating, the structural component being either disposed between the cellular structure and the dissipating component, as shown by the patent GB 2 130 963, or disposed in contact with the incident sound wave, as shown by the document EP 0 911 803.

The invention envisages more precisely panels of this latter type, which is to say comprising a resisting layer with a structural component turned toward the incident sound wave, but is applicable also to panels whose resistive layer comprises a structural component interposed between the dissipating component and the cellular structure.

The structure of the panel according to EP 0 911 803 has the drawback of a resistive layer formed by two metallic superposed layers, namely a cloth and a sheet. The metal used to produce the metallic cloth is preferably stainless steel, whilst the structural layer is an aluminum sheet. In addition to the fact that the metal-metal securement requires a particular technique which is not entirely satisfactory, the use of the two metals of different structure induces corrosion by the appearance of a galvanic couple. Moreover, the density, although low, of the metals used increases substantially the weight of the acoustic panel.

The use of composite materials to produce such dissipating or structural layers is well known and permits providing an acoustic panel that is lighter than an acoustic panel using metal whilst maintaining for said panel its structural and acoustic characteristics.

There exists an abundant literature describing acoustic attenuation panels of the sandwich type comprising an acoustically resistive layer formed by a pierced non-metallic sheet used alone or in association with a porous layer. However, these sheets are generally constituted of plastic materials with high strength at elevated temperature or of plastic materials reinforced with fibers, particularly graphite.

Moreover, these sheets, metallic or non-metallic, merging structural and acoustic characteristics, all comprise circular perforations, aligned or substantially along a diagonal.

To maintain a quantity of open surface permitting good acoustic damping, it is necessary to perforate the structural layer with a suitable number of openings. As a result, this layer is rendered fragile, on the one hand, by the removal of material onto which it is subjected and, on the other hand, by the arrangement of the openings. Thus, the remaining material between two openings does not permit the structural layer to support the transfer of mechanical, aerodynamic and inertial forces toward the motor frame. So as to overcome this problem, it is thus necessary to reinforce said layer by increasing its thickness or decreasing said quantity of open surface, which is at the cost of the acoustical damping quality of said panel.

On the other hand, in the case of an arrangement of the perforation openings on the diagonal, the use of composite materials such as a layer of carbon is not suitable. Thus, the fibers of said material are broken by the removal of the material and their discontinuity does not permit the transfer of forces mentioned above. For this reason, it is necessary to increase the thickness of said structural layer, to the detriment of its weight.

Moreover, the shape of the openings, their symmetrical distribution in the structural layers of the above type, give to them an isotropic mechanical strength which does not in any way take account of the distribution of forces which are to be resisted by the acoustic panel. The forces being greater in the longitudinal direction than in the radial direction, it is thus necessary to produce a panel having a thickness suitable for the transfer of longitudinal forces but over-dimensioned for the transfer of radial forces.

SUMMARY OF THE INVENTION

The present invention seeks precisely to overcome these drawbacks.

To this end, the invention has for its object an acoustic attenuation panel comprising a resistive layer with a reinforced structural component, of the type comprising at least one layer of cellular structure flanked on one side by a resistive layer comprised by at least one porous layer and at least one perforated structural layer, and, on the other side, with a layer forming a total reflector, characterized in that said structural layer is pierced with non-circular holes each having its greatest dimension and its least dimension disposed respectively along two perpendicular axes.

Preferably, the smallest dimension of the holes is greater than or equal to 0.5 mm and the greatest dimension is greater than or equal to 1.5 times the smallest.

Preferably, the greatest dimension of the holes is parallel to the direction of the principal forces to be resisted.

In an application of the invention to the production of panels that are to line the walls of jet engine nacelles, the greater dimension of the holes is parallel to the longitudinal axis of the motor and the holes are distributed in alignments both parallel to said axis of the motor and orthogonal to this latter.

According to one embodiment, the perforated structural layers constituted by mineral or organic fibers, natural or synthetic, impregnated with a thermosetting or thermoplastic resin and polymerized.

The fibers can be unidirectional and parallel, particularly in said direction of the principal forces.

The fibers can also be in the form of a cloth or a stack of cloths whose warp or weft filaments are parallel to said direction of the principal forces.

The shape of the holes is selected from the group comprising rectangular, oblong, hexagonal shapes.

The panels produced according to the invention have the essential advantage that the structural layer thus perforated offers, relative to a structural layer perforated according to the prior art and with an equal open surface amount, a material between the holes that is better distributed, which is to say gathered according to one and or the other of the two privileged axes defined respectively by the greatest dimension and the smallest dimension of the holes.

In other words, said material between the holes is gathered in strips or corridors that are wider between the alignments of the holes, thereby permitting a more effective transfer of forces, via said strips, in the direction of the structures surrounding the panels.

Such an improvement of the transfer of forces can be obtained by maintaining a quantity of open surface of the structural layer suitable to the acoustic attenuation conditions sought and, this whilst minimizing the thickness of said structural layer.

Moreover, in the case of a structural layer made of a composite material and more particularly with the help of fibers pre-impregnated with a resin, the particular shape and arrangement of the perforated holes permit optimum preservation of the continuity of the fibers, particularly in line with said strips or inter-perforation corridors, thereby ensuring a better transfer of forces.

Other characteristics and advantages will become apparent from the description which follows of embodiments of panels according to the invention, which description is given solely by way of example and with respect to the accompanying drawings, in which:

DETAILED DESCRIPTION OF THE PREFERRED EMBODIMENTS

Figure 1:
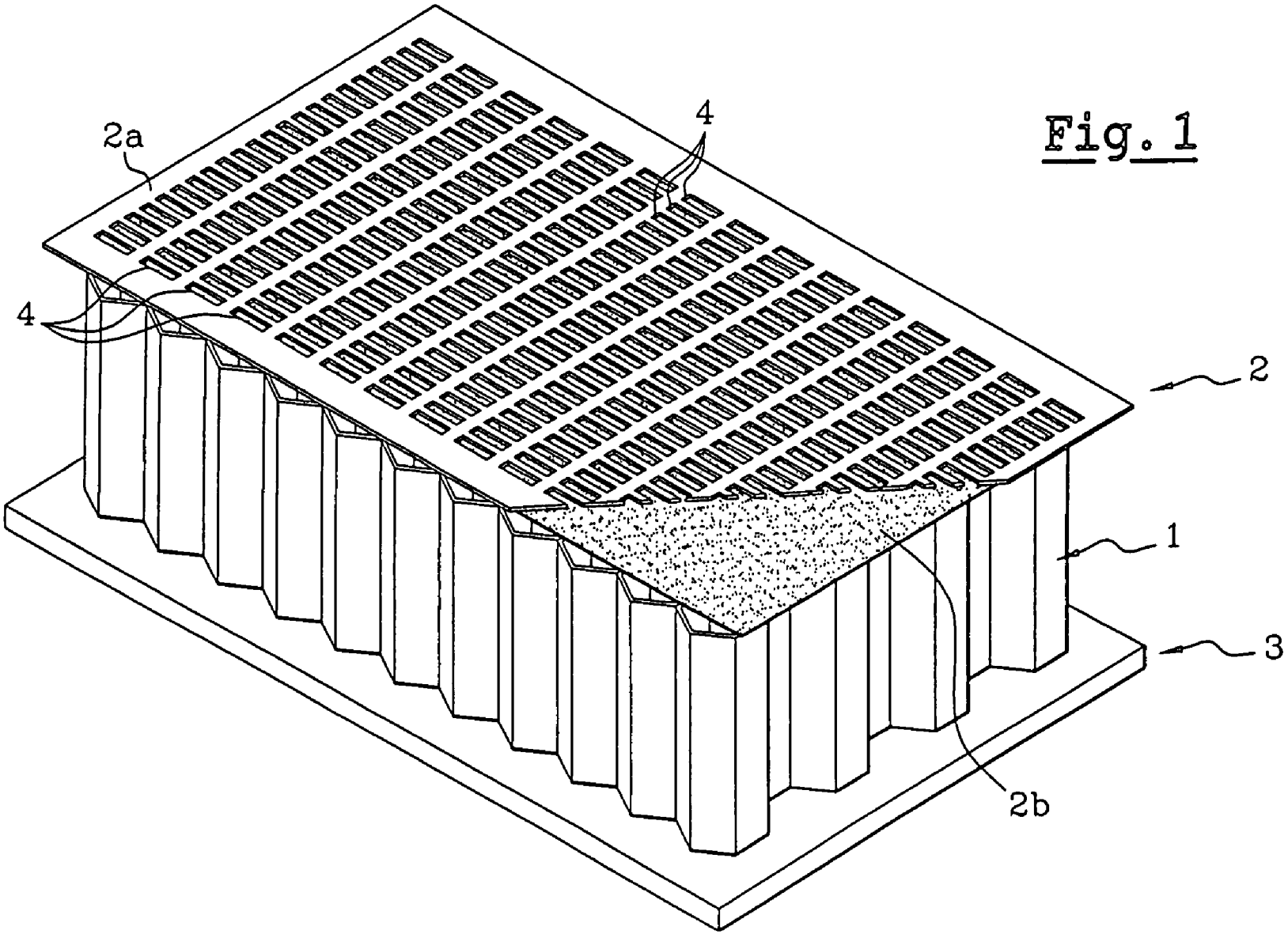
FIG. 1 is a fragmentary perspective view of an acoustic attenuation panel according to the invention.

In FIG. 1, there is shown schematically a sandwich panel structure for acoustic attenuation according to the invention, comprising a central cellular structure 1 flanked, on one side, by an acoustically resistive layer 2 called the front side, formed by two components, and on the other side, by a layer 3, called the rear side, forming a total reflector.

The central cellular structure 1 is formed, in the illustrated embodiment, by a single layer of the honeycomb type. Of course, several layers of honeycomb separated by septa can be provided, in known manner, to constitute several superposed resonators.

The resistive layer 2 is called the front layer in that it is in contact with the aerodynamic flow or the gaseous medium in which travel the sound waves to be damped.

The layer 2 comprises a so-called structural component 2*a*, whose job is to transfer mechanical, aerodynamic and inertia forces toward the motor frame, in the case of the use of such a panel to align for example the external wall delimiting the lower channel of a jet engine. This structural layer 2*a* directly in contact with said aerodynamic flow, also has an acoustic role because it must let pass the sound waves in the direction of the resonator or resonators and, to this end, is pierced with openings or holes 4, of particular shapes and distributions according to the invention.

The second component 2*b* of the resistive layer is interposed between the structural layer 2*a* and the cellular layer 1 and constitutes in known manner a layer of material permeable to air, for example a cloth or superposition of metal cloths formed by stainless steel filaments, or else one or several cloths of carbon fibers.

The rear layer 3 is for example and also in known manner, an imperforate aluminum metallic sheet.

The structural layer 2*a* is formed of a material in a rigid or semi-rigid sheet, which can be a metal, such as aluminum or stainless steel, a composite material, such as a plastic material with high temperature strength or a plastic material reinforced with fibers, particularly graphite, or else a composite material constituted by mineral or organic fibers, natural or synthetic, impregnated with a polymerized thermosetting or thermoplastic resin.

The layer 2*a* is single or else formed by the superposition of several layers of strips such as those shown in FIG. 1.

The layer 2*a* is pierced identically with identical holes 4, that are rectangular and aligned both in the direction of the length and in the direction of the width.

Figure 2:
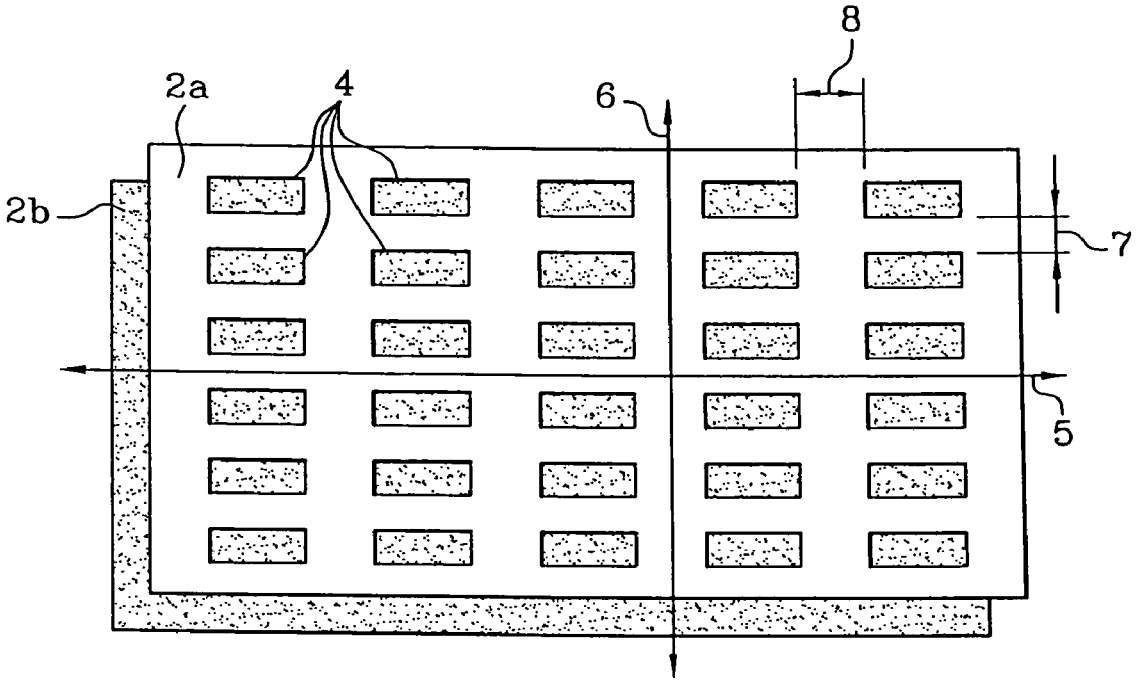
FIG. 2 shows a first embodiment of a structural layer of panel according to the invention.

In FIG. 2, there is shown schematically in a plan view the two superposed components 2*a*, 2*b*.

The holes 4 have a length-width ratio of 2 and their longitudinal axis is parallel to the direction 5 of passage of the principal forces to be resisted by the panel.

This direction 5 corresponds, for a jet engine for example, to the axis of the motor, which exerts its pressure, as well as during reversal of pressure, along its axis.

Figure 3:
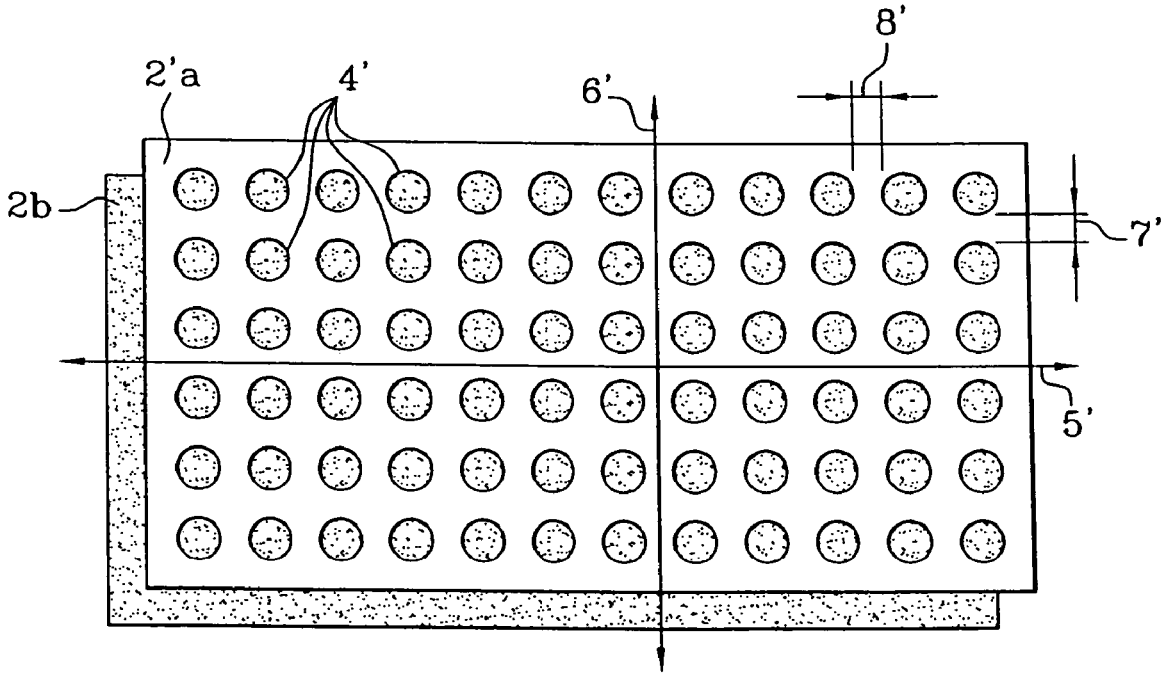
FIG. 3 shows a conventional structural layer with circular perforations.

In FIG. 3 there is shown by comparison a conventional resistive layer with two components 2'*a*, 2'*b* corresponding to the components 2*a*, 2*b* of the invention.

The component 2'*a* is made of the same material as the component 2*a*, has the same surface as this latter and the same total open surface, the openings being constituted by a regular distribution of circular holes 4' equidistant from each other and aligned both according to the direction 5' homologous to the direction 5 of FIG. 2 and in a direction 6' perpendicular to the direction 5' and homologous to the direction 6 of FIG. 2.

As can be seen by carefully comparatively examining FIGS. 2 and 3, in the direction of the width of the rectangles 4, the interval 7 between two alignments of holes 4 is greater than the interval 7' between two homologous alignments of holes 4' and, in the component 2*a*, the sum of the intervals 7 (including the external intervals) is greater than the sum of the intervals 7' of the component 2'*a*. In other words, in the component 2*a*, the total width of material, which is to say said sum of the intervals 7, available to transfer the forces in the direction 5, is very much greater than the corresponding total width of material in component 2'*a*.

Component 2*a* according to the invention thus has a better mechanical strength in the direction 5.

The same is true in the direction 6, called radial, corresponding to the radial axis of the motor. The sum of the intervals 8 is very substantially greater than that of the homologous intervals 8' of component 2'*a*.

It is important to emphasize again that the improvement of the mechanical strength, namely better transfer of forces in the directions 5, 6, is obtained with a structural layer 2*a* identical to the conventional layer 2'*a* as to the nature of the constituent material of the layer and the open quantity, which is to say the total perforated surface.

It is to be noted that the direction 5 being also that of the aerodynamic flow in the motor, the holes 4 are also aligned in the direction of this flow in the air intake conduit, which minimizes the aerodynamic drag.

Thus, not only the perforation of the layer 2*a* according to the invention gives to the acoustic attenuation panels on the air intakes of jet engines a better transfer of the principal forces, mechanical, aerodynamic and inertial, whilst maintaining a quantity of open surface suitable for said panels, whilst minimizing the thickness of said structural layer 2*a*.

It is to be noted that the perforation according to the invention of the structural layer 2*a* is particularly interesting in the case in which said layer 2*a* is constituted from fibers, for example carbon, glass or "Kevlar", pre-impregnated with a suitable resin.

When for example the component 2*a* is constituted by a layer of unidirectional fibers parallel to the direction 5 of the principal forces, the fibers located in the corridors between the alignments along the direction 5 of the holes 4 will not be cut during production of the perforations and will thus ensure a transfer of forces to the maximum of their capacity.

These same uncut fibers will be in much smaller number in the case of a component such as 2'*a*, produced from unidirectional fibers parallel to the direction 5', because of the lower value of the sum of the intervals 7' in comparison with the intervals 7.

In the case of the embodiment of component 2*a* from one or several superposed cloths of pre-impregnated fibers, the warp and weft fibers of the cloth or cloths are preferably disposed parallel to the directions 5 and 6 so as to have the least fibers cut during perforation of the holes 4, both parallel to the direction 5 and parallel to the direction 6.

The perforation of the holes 4 is carried out by any suitable means, for example by punching, all the holes 4 of a strip being perforated in a single pass with the help of a multiple punch press.

The perforations are produced for example on rectangular strips of suitable size for those of the panel to be produced, flat, no matter what the nature of the constituent material. The strips will then be emplaced according to the type of panel to be produced.

In the case of fibers pre-impregnated with resin, the composite material will be consolidated by polymerization of the resin, before being perforated.

The direction of the principal forces (5) of course depends on the type of panel to be produced and its destination. Those skilled in the art will in each case determine this direction and adapt the alignment of the holes 4.

The assembly of the various constituent layers (1, 2 and 3) of the panel are carried out with the help of conventional techniques.

The ratio between length and width of the holes 4 is obviously variable. Preferably, it will be greater than or equal to 2.

Figure 4:
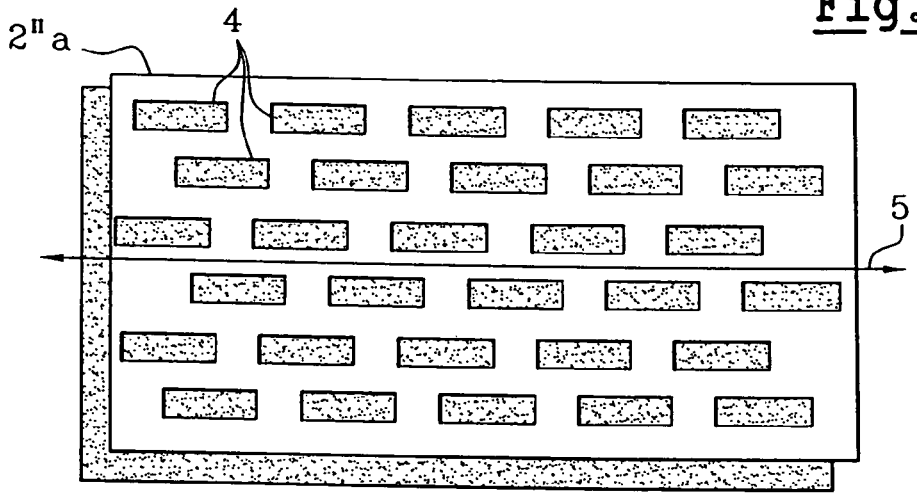
FIG. 4 shows a second embodiment.

Moreover, the alignment of the holes 4 need only be in a single direction, the direction 5 for example as shown in FIG. 4 in which the distribution of said holes 4 in the component 2"*a* is substantially on the diagonal.

Not only the dimensions but also the shape of the perforated holes in the structural layer according to the invention can vary to the extent to which this shape leads to the production of a passage opening having two principal perpendicular axes of which one is substantially longer than the other, so as to provide the structural layer with a better transfer of forces according to one or the other of the two mentioned axes. To this end, one can vary not only the shape and the ratio between length and width of such elongated holes, but also the alignment in one or several directions of said holes as well as their mutual spacing, identical or not, regular or not.

Figure 5:
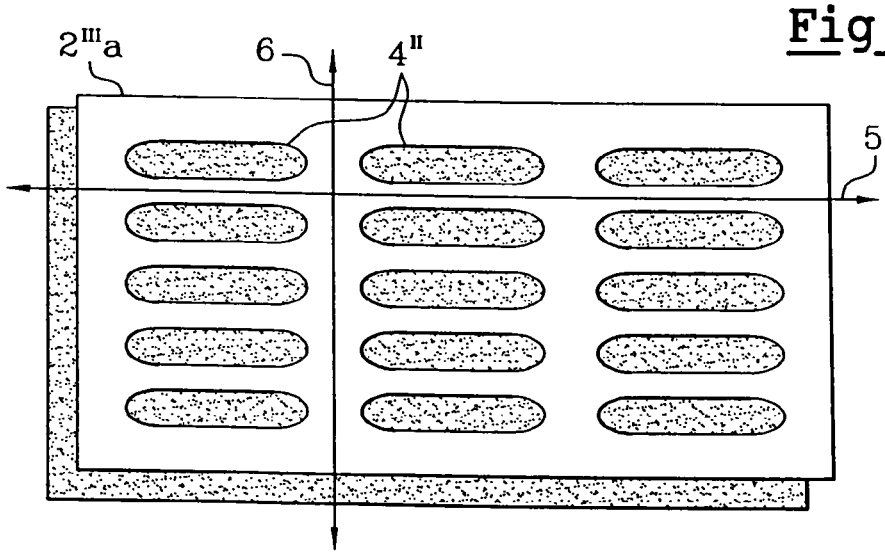
FIG. 5 shows a third embodiment of a structural layer of a panel according to the invention.
Figure 6:
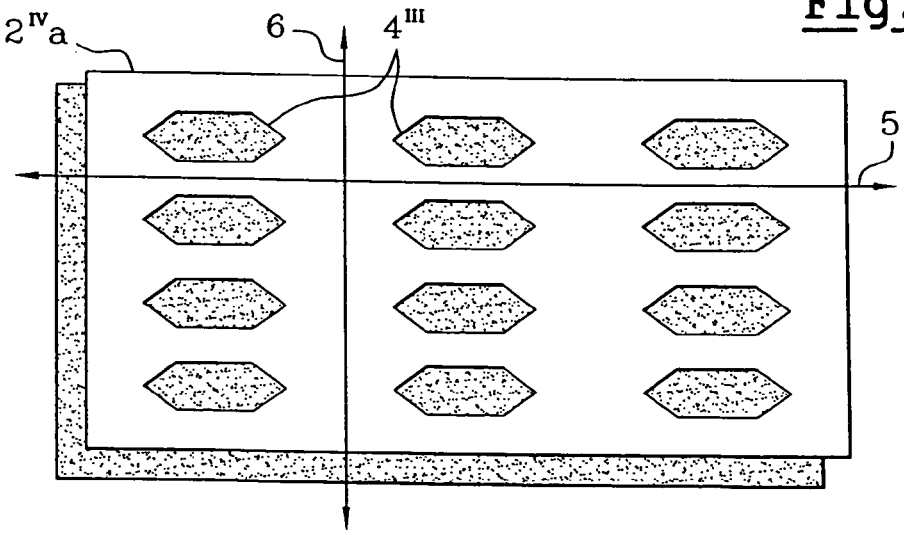
FIG. 6 shows a fourth embodiment.

FIGS. 5 and 6 show two other embodiments of elongated holes.

In FIG. 5, the component 2'''*a* comprises holes 4" distributed like the rectangular holes 4 of FIG. 2 and of oblong shape, particularly rectangular with rounded ends.

In FIG. 6, the component $2^{IV}a$ comprises holes 4''' distributed like those of FIG. 5 and also of oblong shape, namely rectangular with pointed ends, or hexagonal ends.

It is to be noted that the various embodiments described above of the structural layer are applicable equally to panels in which said structural layer is, in contrast to the illustrations given by FIGS. 1 to 6, interposed between the cellular layer (1) and the porous dissipating layer (2*b*).

Generally speaking, the elongated shape of the holes conjugated with an alignment of all the holes in the direction of their elongation, permits, relative to circular holes and an identical open quantity, obtaining a structural layer ensuring better transfer of the forces in the direction of the greatest length of the elongated holes, and this no matter what the quantity of opening sought.

The invention claimed is:

1. An acoustic attenuation panel, comprising at least one layer of cellular structure flanked on a first side by a resistive layer composed of at least one porous layer and at least one perforated structural layer, and on a second opposing side, by a layer forming a total reflector, said at least one perforated structural layer is pierced with identical non circular holes each having a largest dimension and a smallest dimension along respectively two perpendicular axes, said holes are aligned in at least a direction of their elongation, the largest dimension of the holes is parallel to a direction of main forces to be resisted, a material of said at least one perforated structural layer is a composite material comprising mineral or organic fibers that are natural or synthetic, and impregnated with a polymerized thermosetting or thermoplastic resin, the material of the at least one perforated structural layer comprising unidirectional fibers parallel to the largest dimension of the holes or one or more cloths, whose weft or warp threads are disposed respectively along the largest dimension and the smallest dimension of said holes.

2. The acoustic attenuation panel according to claim 1, wherein the smallest dimension of the holes is greater than or equal to 0.5 mm and the largest dimension of the holes is greater than or equal to 1.5 times the smallest.

3. The acoustic attenuation panel according to claim 2, wherein said holes are selected from the group consisting of rectangular holes, oblong holes having rounded or pointed ends, and hexagonal holes.

4. The acoustic attenuation panel according to claim 1, wherein said holes are selected from the group consisting of rectangular holes, oblong holes having rounded or pointed ends, and hexagonal holes.

5. The acoustic attenuation panel according to claim 1, connected to a wall of a nacelle of a jet engine, wherein the largest dimension of the holes is parallel to a longitudinal axis of the engine.

6. The acoustic attenuation panel according to claim 1, wherein said fibers are chosen from the group consisting of carbon, glass and Kevlar fibers.

7. The acoustic attenuation panel according to claim 1, wherein said at least one porous layer is interposed between said cellular layer and said at least one perforated structural layer.

8. The acoustic attenuation panel according to claim 1, wherein said holes are aligned in two perpendicular directions.

9. The acoustic attenuation panel according to claim 1, wherein the material of the at least one perforated structural layer comprises one or more cloths, whose weft or warp threads are disposed respectively along the largest dimension and the smallest dimension of said holes.

* * * * *